US010526194B2

(12) United States Patent
Van Der Molen

(10) Patent No.: US 10,526,194 B2
(45) Date of Patent: Jan. 7, 2020

(54) SYSTEM FOR TRANSPORTING AND STORING A LIQUID AND FOR TRANSPORTING SAID LIQUID FROM THE CONTAINER TO A DESTINATION OUTSIDE OF THE CONTAINER

(71) Applicant: Scholle IPN IP BV, SX Tilburg (NL)

(72) Inventor: Peter Van Der Molen, SX Tilburg (NL)

(73) Assignee: Scholle IPN IP BV (NL)

( * ) Notice: Subject to any disclaimer, the term of this patent is extended or adjusted under 35 U.S.C. 154(b) by 0 days.

(21) Appl. No.: 16/323,626

(22) PCT Filed: Aug. 17, 2017

(86) PCT No.: PCT/NL2017/050540

§ 371 (c)(1),
(2) Date: Feb. 6, 2019

(87) PCT Pub. No.: WO2018/034567

PCT Pub. Date: Feb. 22, 2018

(65) Prior Publication Data

US 2019/0202681 A1 Jul. 4, 2019

(30) Foreign Application Priority Data

Aug. 18, 2016 (NL) ..... 2017331

(51) Int. Cl.
*B67D 7/02* (2010.01)

(52) U.S. Cl.
CPC ..... *B67D 7/0294* (2013.01)

(58) Field of Classification Search
CPC ..... B67D 7/0294; B67D 7/0288; B65D 51/2835; B65D 51/285; B65D 51/20
(Continued)

(56) References Cited

U.S. PATENT DOCUMENTS 4,375,864 A * 3/1983 Savage ..... B65D 77/067 222/81
4,421,146 A * 12/1983 Bond ..... B65D 77/06 141/349
(Continued)

FOREIGN PATENT DOCUMENTS

DE 8708058 U1 10/1987
FR 2732003 A1 9/1996
(Continued)

*Primary Examiner* — Benjamin R Shaw
(74) *Attorney, Agent, or Firm* — The Watson IP Group, PLC; Jovan N. Jovanovic

(57) ABSTRACT

The present invention relates to a system for transporting and storing a liquid and for transporting said liquid from the container to a destination outside of the container. The system comprises a container with a neck portion, a cap assembly secured on the neck portion and a coupler assembly configured to be mechanically coupled to the cap assembly for a liquid connection to and/or from the container, comprising a male probe to be connected to a female part of the cap assembly. The female part has an essentially cylindrical body defining an axial bore extending from an insert opening for the male probe to an opposed plug opening for a plug which serves to close off the bore fluid-tight. According to the invention, a seal cover is provided over the bore, essentially parallel to the plug, which serves to close off the bore airtight.

10 Claims, 8 Drawing Sheets

(58) Field of Classification Search
USPC ..... 222/400.7, 81; 141/330, 329, 351
See application file for complete search history.

(56) References Cited

U.S. PATENT DOCUMENTS

RE32,354 E * 2/1987 Savage ..... B65D 77/067 141/349
4,708,260 A * 11/1987 Siegal ..... B65D 77/067 141/351
5,232,125 A * 8/1993 Adams ..... B65D 41/0471 141/330
5,259,534 A * 11/1993 Lynd ..... B67D 3/0032 141/346
5,289,854 A * 3/1994 Baker ..... B67D 3/0038 141/18
5,370,270 A * 12/1994 Adams ..... B65D 41/0471 141/330
5,467,806 A * 11/1995 Stricklin ..... F16L 37/28 141/346
5,937,921 A * 8/1999 Guglielmini ..... B67D 3/0032 141/351
5,957,316 A * 9/1999 Hidding ..... B67D 3/0032 141/348
6,126,045 A * 10/2000 Last ..... B65D 41/02 222/501
6,170,543 B1 1/2001 Simmel et al.
6,193,113 B1 * 2/2001 Hidding ..... B67D 3/0032 141/18
7,086,430 B2 * 8/2006 Walton ..... B67D 3/0032 141/319
2007/0029345 A1 * 2/2007 Lee ..... B01F 3/12 222/145.1
2007/0181215 A1 8/2007 Kaempf
2013/0199662 A1 * 8/2013 Gebbink ..... B65D 47/00 141/2
2017/0001853 A1 * 1/2017 Park ..... B67D 1/1272

FOREIGN PATENT DOCUMENTS

WO 9410081 A1 5/1994
WO 9905446 A1 2/1999
WO 2011096811 A1 8/2011

* cited by examiner

SYSTEM FOR TRANSPORTING AND STORING A LIQUID AND FOR TRANSPORTING SAID LIQUID FROM THE CONTAINER TO A DESTINATION OUTSIDE OF THE CONTAINER

FIELD OF THE INVENTION

The present invention relates to a system for transporting and storing a liquid and for transporting said liquid from the container to a destination outside of the container. The system is in particular suitable for safe transfer of liquids according to a 'closed transfer system', in particular to transfer crop protection products into a sprayer.

BACKGROUND OF THE INVENTION

Such a system according to the preamble of claim 1 is well known and commercially available from the applicant. It is described in WO99/05446, the content of which is considered to be incorporated by reference. The known systems have a small bore, in the order of several millimetres.

OBJECT OF THE INVENTION

The aim of the invention is to provide such a system suitable for large diameter bores, in particular exceeding 30 mm.

SUMMARY OF THE INVENTION

It has been found that when the known cap assembly is scaled up to a bore having a diameter exceeding 30 mm, e.g. to be assembled onto a container comprising a relatively large inlet opening, in particular exceeding 30 mm, in particular industry standard containers with 63 mm closures, unintentional release of the plug occurs. In order to ensure a closed transfer system, the cap assembly is to be assembled onto the container straight after the filling of the container. Hereafter, the containers are transported to the site where the liquid is to be used. During transport there is a risk of dropping such a container filled with liquid. As the container is closed, liquid sloshing in the container, e.g. as a result of dropping, causes a hydrodynamic load exerted onto the plug of the cap assembly, and hence increases the risk of unintentional release of the plug.

The invention aims to provide a system suitable for bores comprising a diameter exceeding 30 mm.

This aim is achieved in that a seal cover is provided over the bore, essentially parallel to the plug, which serves to close off the bore airtight. Such an airtight seal cover over the bore, parallel to the plug, counteracts possible hydrodynamic loads caused by sloshing and hence the risk of unintentional release of the plug is significantly reduced.

Advantageously, the bore is large, e.g. having a diameter exceeding 30 mm, in particular 45 mm, in particular 60 mm or even larger.

In a preferred embodiment, the inner wall of the cylindrical body further comprises a seal cover seat at an end adjacent the insert opening, extending around the bore, for a seal cover which serves to close off the bore airtight, and the essentially cylindrical body comprising a seal cover abutment surface for the seal cover, the seal cover abutment surface extending radially adjacent the insert opening, the seal cover being provided with a sealing system with at least one radially deformable seal element adapted to releasably engage with the seal cover seat, the seal cover being designed such that in a transfer position the seal cover abuts against the seal cover abutment surface and the seal elements abut against the seal cover seat, thereby covering the insert opening airtight.

BRIEF DESCRIPTION OF THE DRAWINGS

The invention is further elucidated in relation to the drawings, in which.

DETAILED DESCRIPTION OF EMBODIMENTS

Figure 1A:
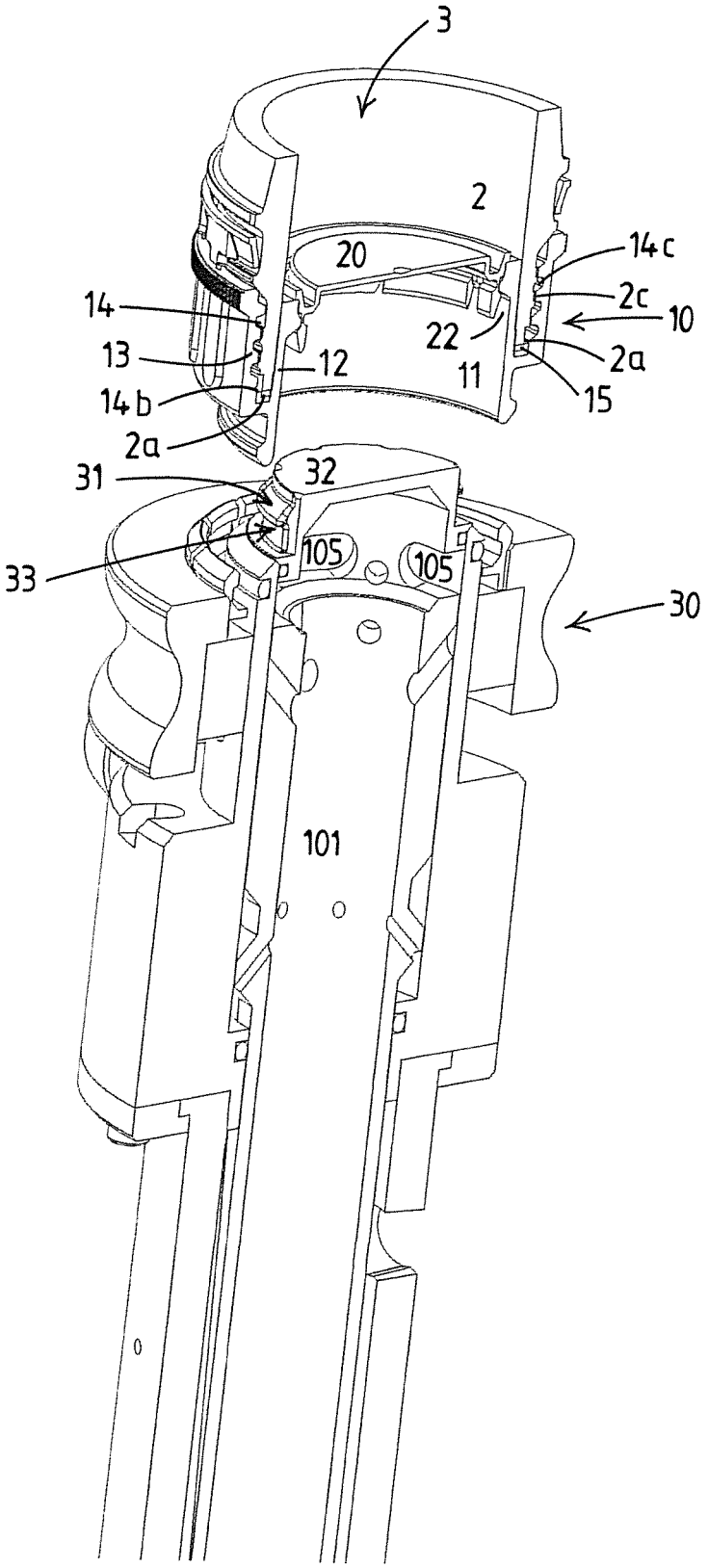
FIG. 1*a* is a perspective view of a system according to the invention comprising a portion of the container, the cap assembly and part of the coupler assembly, wherein the plug is in a first position.

FIGS. 1*a*-1*c* and FIGS. 2-6 show different views and details of a similar embodiment of a system of the invention. Same parts are given same reference numerals.

Figure 1B:
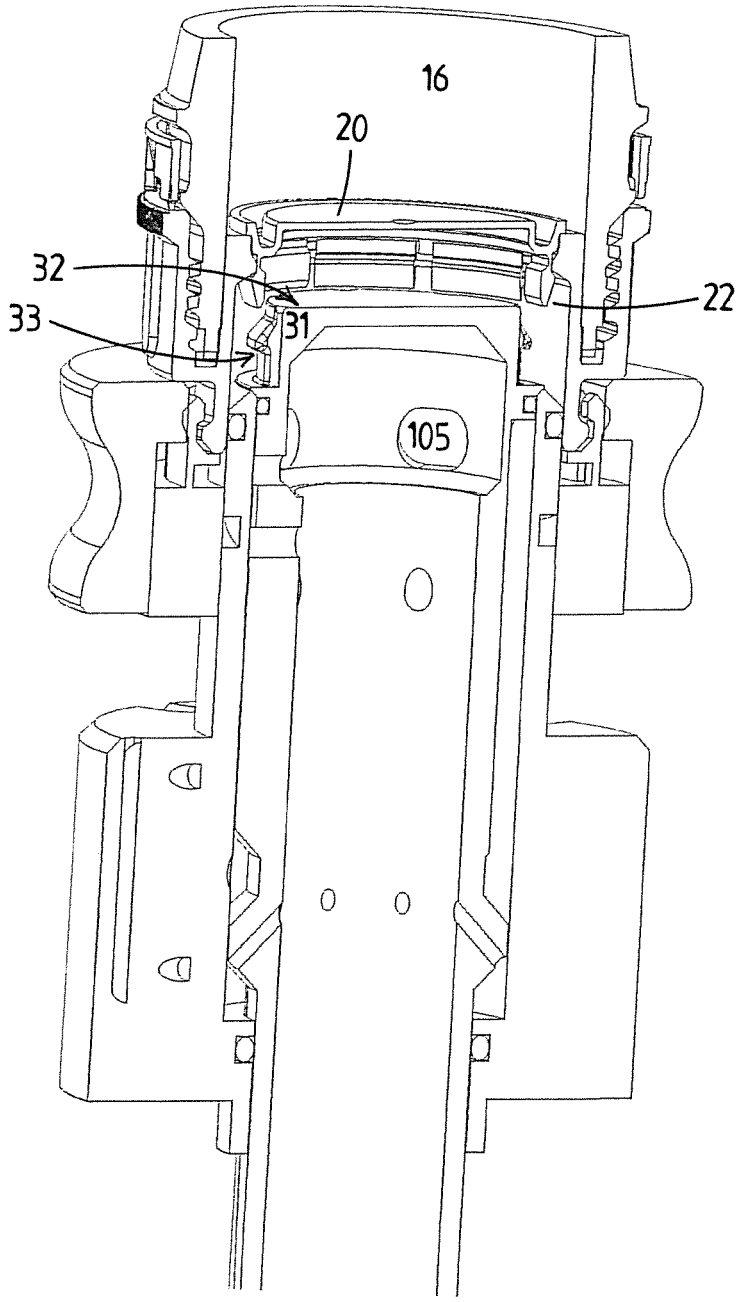
FIG. 1*b* is a perspective view of the system of FIG. 1*a*, wherein the coupler assembly has moved towards the plug, the plug still being in a first position.
Figure 1C:
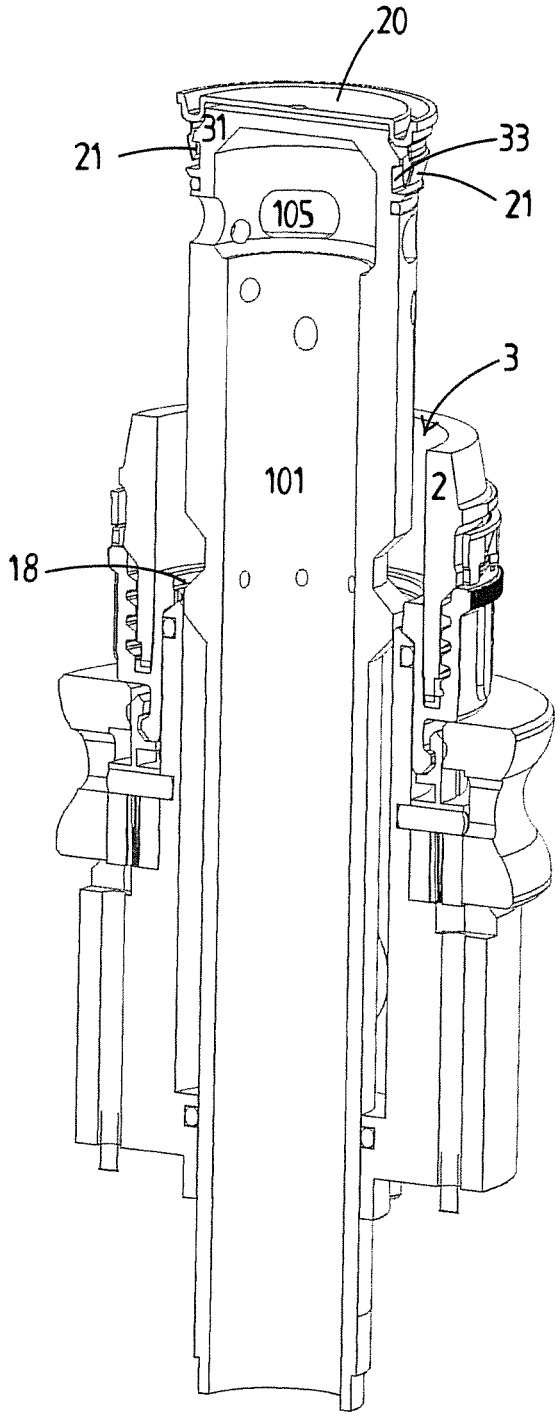
FIG. 1*c* is a perspective view of the system of FIG. 1*a*, wherein the male probe of the coupler assembly has been connected to a female part of the cap assembly, wherein the plug is in a fourth position.

In FIGS. 1*a*-1*c*, an entire system for transporting and storing a liquid and for transporting said liquid from the container to a destination outside of the container is shown. The system comprises:

- a container for transporting and storing a liquid, comprising a container body provided with a neck portion 2;
- a cap assembly 10 secured on the neck portion for fluidly-tight closing the container body;
- a coupler assembly 30 configured to be mechanically coupled to the cap assembly 10 so as to achieve a coupled configuration for a liquid connection to and/or from the container, comprising a male probe 31 to be connected to a female part 11 of the cap assembly.

In particular, the neck portion 2 surrounds an inlet opening 3, in particular an inlet opening having a diameter exceeding 30 mm, in particular 45 mm, in particular 60 mm or even larger.

The cap assembly 10, shown in other views in FIGS. 2-5, comprises the female part 11 and a plug 20, the female part having an essentially cylindrical body comprising two concentric interconnected cylindrical walls 12, 13 defining there between a cylindrical slit 14 having an open end 14*a* and a closed end 14*b* where the outer cylindrical wall 13 is connected to the inner cylindrical wall 12. The slit is adapted to receive, at the open end thereof, the neck portion 2 of the container body to provide a fluid-tight closure around the neck portion.

In the shown embodiment, the container is positioned with its neck portion downwards, and hence the open end of the cylindrical slit corresponds to top end and the closed end to the bottom end. It is also conceivable that the container is positioned with its neck portion upwards, allowing the cap assembly to be positioned over the neck portion.

In the shown embodiment, a seal ring 15 is provided at the closed bottom end of the cylindrical slit 14*b* to assist the fluid-tight closure of an upper end 2*a* of the neck portion 2 of the container body by the female part 11 of the cap assembly.

In the shown embodiment, the cylindrical slit 14 comprises a slit engagement surface 14*c*, here provided at the outer cylindrical wall. It is also conceivable that the slit engagement surface is provided at the inner cylindrical wall, or at both walls. The slit engagement surface is adapted to engage with a corresponding neck engagement surface 2*c* at the neck portion 2 of the container body to provide a fluid-tight closure around the neck portion. The slit engagement surface and corresponding neck engagement surface are here formed by cooperating screw thread. Other engagement mechanisms, e.g. involving a rim and a recess, are also conceivable.

In the shown embodiment, the outer cylindrical wall 13 is provided with a tamper-evident ring 19, here extending as a continuation of the outer cylindrical wall. This tamper-evident ring has to be removed to be able to remove the cap assembly from the neck portion of the container body. Accordingly, one can determine from the status of the tamper-evident ring whether the cap assembly has been removed from the container or not.

Figure 2:
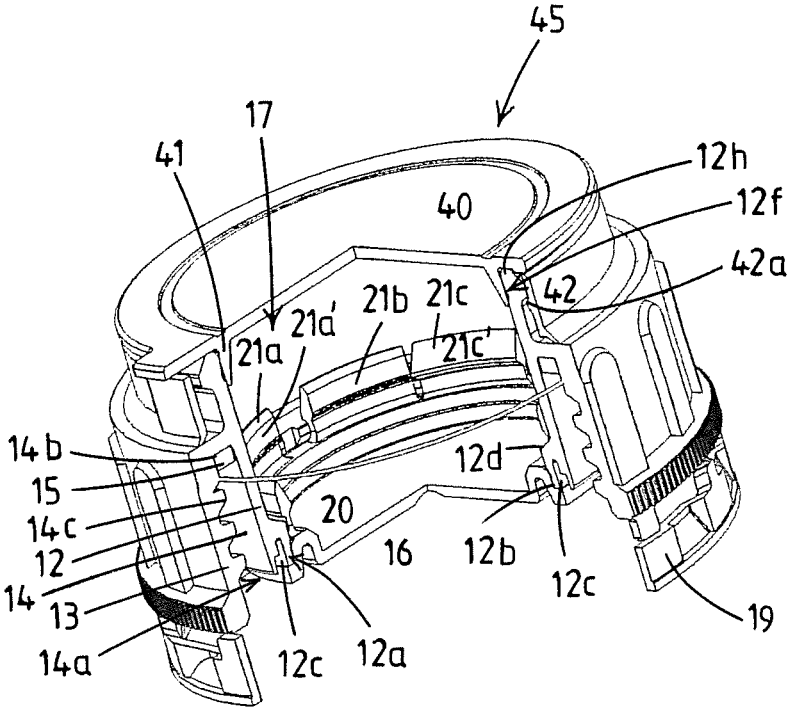
FIG. 2 shows a partly open perspective view of a cap assembly according to the invention.
Figure 3:
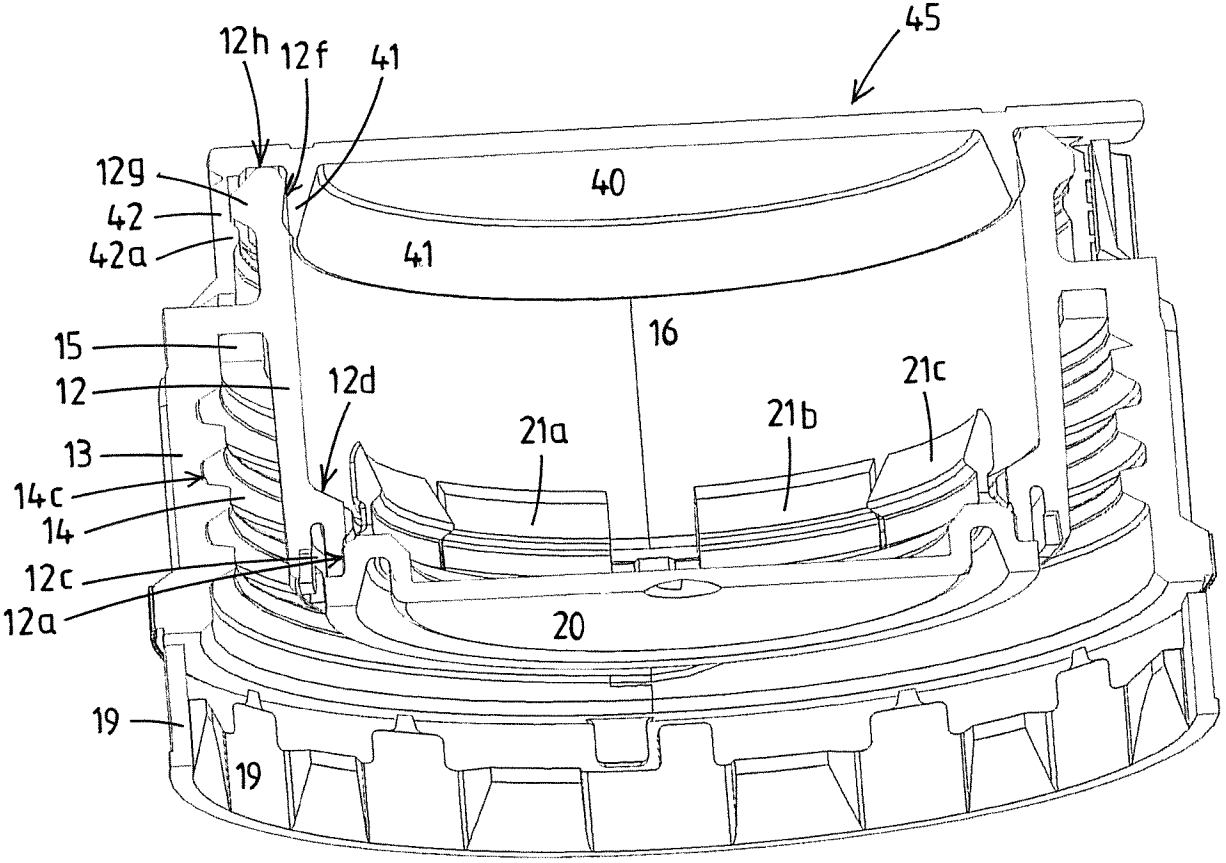
FIG. 3 shows a view of the inside of the cap assembly of FIG. 2 cut in halves.
Figure 4:
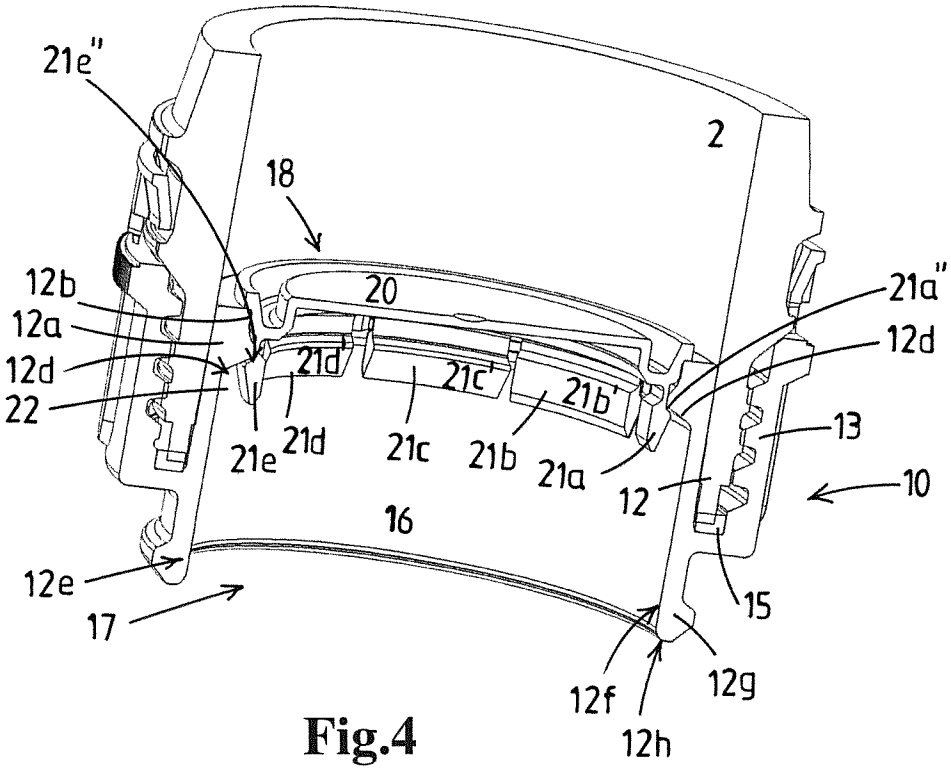
FIG. 4 shows a perspective view of the inside of a cap assembly and a neck portion of a container cut in halves.
Figure 5:
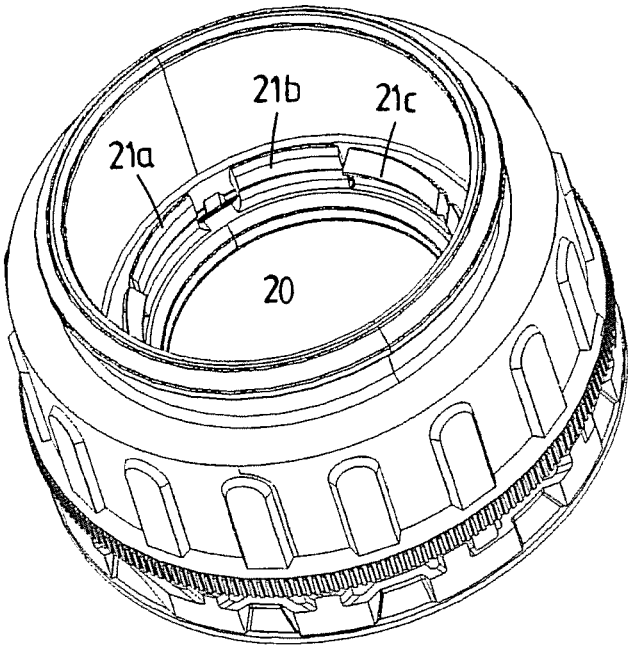
FIG. 5 shows a cap assembly including a plug in a perspective view.
Figure 6:
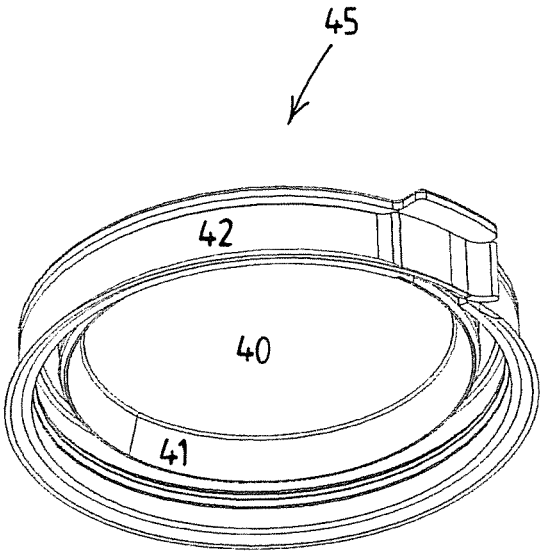
FIG. 6 shows an embodiment of a seal cover according to the invention.

It is noted that in FIGS. 2 and 3 the inner cylindrical wall 12 comprises a shallow slit 12*c* at end 12*a* adjacent the plug opening 18. In the shown embodiment this is provided for constructive purposes relating to injection moulding.

The inner wall of the cylindrical body 12 defines an axial bore 16 extending from an insert opening 17 for the male probe through the body to an opposed plug opening 18. The openings of the shown embodiment are of similar dimension. The insert opening and plug opening are provided at opposed ends of the body. When the cap assembly 10 is engaged with the neck portion 2 of the container body, the inlet opening 3 is within the axial bore 16.

The inner wall of the cylindrical body 12 comprises a seat 12*b* adjacent the plug opening 18, extending around the bore 16, for the plug 20 which serves to close off the bore fluid-tight.

This plug and its operation has extensively been described and disclosed in WO99/05446. The bore of the female part between the insert opening 17 and the seat 12*b* comprises a shoulder 12*d*, facing towards the insert opening. The plug 20 is provided with a hooking system with multiple elastic hooking parts 21*a*, 21*b*, 21*c*, 21*d*, 21*e*, with corresponding hooking surfaces 21*a*", 21*e*". As visible in FIG. 1*a*, at least one of the hooking parts rests in a first position with its hooking surface against the shoulder, in which first position the plug 20 closes off the bore and hence fluidly-tight closes the plug opening of the container body.

The coupler assembly 30 has a male probe 31 with a head and a recess 33 located behind the head for receiving at least one of the hooking parts of the plug when the male probe is inserted into the bore, in particular at least one of surfaces 21*a*', 21*b*', 21*c*', 21*d*', 21*e*' of the hooking parts, so that the plug connects with the male probe. Radially next to the at least one of the hooking parts in its first position there is a space 22 between the hooking part 21*a*, 21*b*, 21*c*, 21*d*, 21*e* and the female part 11.

The at least one hooking part is designed such that when the male is inserted into the bore—the head 32 of the male probe pushes the hooking part from its first position into this space 22 to a second position which is located radially further outward compared with the first position, in which second position the plug still closes off the bore and hence fluidly-tight closes the plug opening of the container body.

The at least one hooking part is further designed such that at least one of the hooking parts, after axially passing the head 32 of the male probe towards a bottom of the container body, springs elastically inward to a third position and falls into the recess 33 of the male probe while contact between the hooking surface and the shoulder is maintained and while the contact between hooking surface and shoulder is maintained the plug still closes off the bore and hence fluidly-tight closes the plug opening of the container body.

The recess 33 in the male probe is such that a radial space is present between the hooking part 21, located in its third position, and the male probe 31, in such a way that inserting the male probe 31 further into the bore 16 towards a bottom of the container body causes the hooking part 21 to pass the shoulder 22 in the bore, the hooking part moves under the influence of a force exerted by the shoulder of the bore on the hooking part to a fourth position, as visible in FIG. 1*c*, which is located further inward in the recess 33 compared with the third position, such that the plug engaged with the male probe opens the bore and hence allows fluid to pass from and to the container body.

Advantageously, the connector assembly has been designed such that the plug 20 is free of the bore 16 when the male probe has been inserted fully into the bore, with at least one of the hooking parts 21 of the plug 20 springing back elastically from the fourth position to the third position when it comes out of the bore.

The shown male probe has an internal axial passage 101 for passage of the fluid in which one or more ports 105 are provided, each extending from the outer surface of the male probe to an outlet in the axial passage.

According to the present invention, a seal cover 45 is provided over the bore 16, essentially parallel to the plug 20, which serves to close off the bore airtight. In particular, the shown seal cover 45 comprises a seal surface 40 extending across and parallel to the insert opening 17. The seal cover 45 is shown in detail in FIG. 6. Alternative configurations of a seal cover are also conceivable as long as the bore is closed off airtight. For example a topseal or the like can be applied as well.

In the shown embodiment, the inner wall 12 of the cylindrical body further comprises a seal cover seat 12*f* at an end 12*e* adjacent the insert opening 17, extending around the bore 16, for the seal cover 45. Further, in the shown embodiment, the essentially cylindrical body comprises a seal cover abutment surface 12*h* for the seal cover, the seal cover abutment surface extending radially adjacent the insert opening.

The seal cover is here provided with a sealing system with at least one radially deformable seal element 41 adapted to releasably engage with the seal cover seat 12*f*, here is a radially expandable and compressible ring-shaped collar extending perpendicular to the sealing surface of the seal cover. The seal cover is designed such that in a transfer position the seal cover abuts against the seal cover abutment surface 12*h* and the seal elements abut against the seal cover seat, thereby covering the insert opening airtight.

Furthermore, in the shown embodiment, the seal cover is provided with a tamper-evident tear ring 42 extending around the essentially cylindrical body, which has to be removed prior to the removal of the seal cover. In this embodiment, the tamper evident ring 42 comprises a rib 42*a* engaging below a thickened end rim 12*g* of the inner wall 12

What is claimed is:

1. A system for transporting and storing a liquid and for transporting said liquid from the container to a destination outside of the container, the system comprising:

a container for transporting and storing a liquid, comprising a container body provided with a neck portion;

a cap assembly secured on the neck portion for fluidly-tight closing the container body;

a coupler assembly configured to be mechanically coupled to the cap assembly so as to achieve a coupled configuration for a liquid connection to and/or from the container, comprising a male probe to be connected to a female part of the cap assembly;

wherein the cap assembly comprises the female part and a plug, the female part having an essentially cylindrical body comprising two concentric interconnected cylindrical walls defining there between a cylindrical slit having an open end and a closed end where the outer cylindrical wall is connected to the inner cylindrical wall, the slit being adapted to receive the neck portion of the container body to provide a fluid-tight closure around the neck portion;

the inner wall of the cylindrical body defining an axial bore extending from an insert opening for the male probe through the body to an opposed plug opening at opposed ends of the body;

the inner wall of the cylindrical body comprising a seat adjacent the plug opening, extending around the bore, for the plug which serves to close off the bore fluid-tight;

wherein the bore of the female part between the insert opening and the seat comprises a shoulder, facing towards the insert opening, and the plug is provided with a hooking system with multiple elastic hooking parts with corresponding hooking surfaces, at least one of the hooking parts resting in a first position with its hooking surface against the shoulder, in which first position the plug closes off the bore and hence fluidly-tight closes the plug opening of the container body;

wherein the coupler assembly has a male probe with a head and a recess located behind the head for receiving at least one of the hooking parts of the plug when the male probe is inserted into the bore, so that the plug connects with the male probe, wherein radially next to the at least one of the hooking parts in its first position there is a space between the hooking part and the female part, wherein the at least one hooking part is designed such that—when the male is inserted into the bore—the head of the male probe pushes the hooking part from its first position into this space to a second position which is located radially further outward compared with the first position, in which second position the plug still closes off the bore and hence fluidly-tight closes the plug opening of the container body; and such that at least one of the hooking parts, after axially passing the head of the male probe towards a bottom of the container body, springs elastically inward to a third position and falls into the recess of the male probe while contact between the hooking surface and the shoulder is maintained and while the contact between hooking surface and shoulder is maintained the plug still closes off the bore and hence fluidly-tight closes the plug opening of the container body; wherein the recess in the male probe is such that a radial space is present between the hooking part, located in its third position, and the male probe, in such a way that inserting the male probe further into the bore towards a bottom of the container body causes the hooking part to pass the shoulder in the bore, the hooking part moves under the influence of a force exerted by the shoulder of the bore on the hooking part to a fourth position which is located further inward in the recess compared with the third position, such that the plug engaged with the male probe opens the bore and hence allows fluid to pass from and to the container body;

wherein a seal cover is provided over the bore, essentially parallel to the plug, which serves to close off the bore airtight.

2. The system according to claim 1, in which the seal cover comprises a seal surface extending across and parallel to the insert opening.

3. The system according to claim 1, wherein the inner wall of the cylindrical body further comprises a seal cover seat at an end adjacent the insert opening, extending around the bore, for the seal cover, the seal cover being provided with a sealing system with at least one radially deformable seal element adapted to releasably engage with the seal cover seat.

4. The system according to claim 1, in which the at least one radially deformable seal element is a radially expandable and compressible ring-shaped collar extending perpendicular to the sealing surface of the seal cover.

5. The system according to claim 1, wherein the seal cover is provided with a tamper-evident tear ring extending around the essentially cylindrical body.

6. The system according claim 1, wherein the outer cylindrical wall being provided with a tamper-evident ring.

7. The system according to claim 1, wherein a seal ring is provided at the closed end of the cylindrical slit to assist the fluid-tight closure of an upper end of the neck portion of the container body by the female part of the cap assembly.

8. The system according to claim 1, wherein the cylindrical slit comprising a slit engagement surface adapted to engage with a corresponding neck engagement surface at the neck portion of the container body to provide a fluid-tight closure around the neck portion.

9. The system according to claim 1, wherein the connector assembly has been designed such that the plug is free of the bore when the male probe has been inserted fully into the bore, with at least one of the hooking parts of the plug springing back elastically from the fourth position to the third position when it comes out of the bore.

10. The system according to claim 1, wherein the male probe has an internal axial passage for passage of the fluid in which one or more ports are provided, each extending from the outer surface of the male probe to an outlet in the axial passage.

* * * * *